US005427654A

United States Patent [19]

Gray et al.

[11] Patent Number: 5,427,654

[45] Date of Patent: Jun. 27, 1995

[54] MULTI-PLY WEB FORMING APPARATUS

[75] Inventors: Paul T. Gray, Bolton; Eric Ormesher, Wigan, both of England

[73] Assignee: Beloit Technologies, Inc., Wilmington, Del.

[21] Appl. No.: 107,406

[22] Filed: Aug. 16, 1993

[30] Foreign Application Priority Data

Aug. 19, 1992 [WO] WIPO ..... PCT/GB92/01517

[51] Int. Cl.[6] ..... D21F 1/00; D21F 1/48

[52] U.S. Cl. ..... 162/301; 162/303; 162/304

[58] Field of Search ..... 162/133, 123, 303, 304, 162/300, 301, DIG. 7

[56] References Cited

U.S. PATENT DOCUMENTS

| | | | |
|---|---|---|---|
| 4,830,709 | 5/1989 | Turner et al. | 162/304 |
| 5,074,964 | 12/1991 | Partanen | 162/203 |
| 5,167,770 | 12/1992 | Bubik et al. | 162/301 |
| 5,203,967 | 4/1993 | Bando et al. | 162/301 |
| 5,282,933 | 2/1994 | Bubik et al. | 162/300 |

FOREIGN PATENT DOCUMENTS

| | | |
|---|---|---|
| 0389404 | 9/1990 | European Pat. Off. . |
| 0397430 | 11/1990 | European Pat. Off. . |
| 0491274 | 6/1992 | European Pat. Off. . |
| 9009481 | 8/1990 | WIPO . |
| 9110775 | 7/1991 | WIPO . |

*Primary Examiner*—Karen M. Hastings

*Attorney, Agent, or Firm*—Dirk J. Veneman; Raymond W. Campbell; David J. Archer

[57] ABSTRACT

A multi-ply web forming apparatus is disclosed for forming a top ply on a base ply. The former includes a looped lower forming wire for receiving the base ply thereon and a top looped forming wire cooperating with and disposed above the lower wire for defining therebetween a generally horizontally disposed forming section having a first and a second end. A turning bar defines a curved surface for guiding the lower wire. A secondary headbox ejects stock towards and onto the base ply. A curved dewatering shoe is disposed beneath the lower wire such that a portion of water from the top ply is ejected through the top wire. A vacuum slot collects a portion of water upwardly away from the top wire. An inverted vacuum box is disposed downstream relative to the vacuum slot and a plurality of dewatering blades disposed between a curved face of the vacuum box and the top wire guide the top wire therepast. A plurality of dewatering foils are disposed on the opposite side of the wire relative to the blades such that the consistency of the stock forming the top ply is increased during passage thereof through the forming section while maintaining the consistency of the top ply uniform in a "Z" direction so that crushing of the resultant web is inhibited.

5 Claims, 5 Drawing Sheets

MULTI-PLY WEB FORMING APPARATUS

BACKGROUND OF THE INVENTION

FIELD OF THE INVENTION

The present invention relates to a multi-ply web forming apparatus. More specifically, the present invention relates to a multi-ply web forming apparatus for forming a top ply on a base ply.

INFORMATION DISCLOSURE STATEMENT

Bel Bond TM top wire formers permit upward removal of water from stock so that the resultant web has more uniform surface characteristics thereon.

More specifically, when stock is ejected from a headbox onto a fourdrinier wire, water is drained downwardly, leaving a fibrous web on the upper surface of the wire. Thereafter, the fibrous web is transferred to a press section for removing more water from the formed web.

The aforementioned downward drainage of water causes uneven surface characteristics on the resultant web. The Bel Bond TM unit is a top wire unit which includes a looped top wire which cooperates with the lower fourdrinier wire to define therebetween a forming section.

Water is removed upwardly from the stock during passage thereof through the forming section such that more even surface characteristics are imparted to the resultant formed web.

However, in the formation of a multi-ply web, a base ply is initially formed on the lower fourdrinier wire, and a secondary headbox is disposed immediately upstream relative to a top wire Bel Bond TM apparatus.

Although the aforementioned arrangement has proved successful in the formation of a multi-ply web, there exists a tendency for the top ply to crush during subsequent pressing thereof.

More particularly, when the stock is ejected from the secondary headbox, there exists a tendency for a fibrous mat to form on the underside of the top wire, such fibrous mat tends to trap lower consistency stock therebelow so that in the subsequent pressing operation, crushing of the web occurs.

The present invention seeks to overcome the aforementioned problem by removing water evenly from the top ply resulting in a more uniform consistency of stock in a "Z" direction.

Therefore, it is a primary objective of the present invention to provide a multi-ply web forming apparatus which overcomes the aforementioned disadvantages of the aforementioned apparatus and to provide a considerable contribution 1:o the art of multi-ply web forming.

Another object of the present invention is the provision of a multi-ply web forming apparatus which inhibits crushing of the resultant web, particularly heavy weight webs.

Another object of the present invention is the provision of a multi-ply web forming apparatus which includes a vacuum slot 1for assisting in the upward removal of water.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a multi-ply web forming apparatus for forming a top ply on a base ply. The former includes a looped lower forming wire for receiving the base ply thereon. A top looped forming wire cooperates with, and is disposed above the lower wire, for defining therebetween a generally horizontally disposed forming section having a first and a second end. A turning bar defines a curved surface, which is disposed beneath the lower forming wire and upstream relative to the first end of the forming section for guiding the lower wire. A secondary headbox is disposed closely adjacent to the turning bar such that stock ejected from the secondary headbox towards the first end of the forming section is deposited on the base ply, the stock ejected from the secondary headbox generating the top ply.

A curved dewatering shoe is disposed beneath the lower wire and adjacent to the first end of the forming section. The curved shoe has a center of curvature which is disposed below the lower wire such that a portion of water from the top ply is ejected through the top wire.

A vacuum slot means is disposed above the top wire and immediately downstream relative to the dewatering shoe for collecting the portion of water upwardly away from the top wire.

An inverted vacuum box is disposed immediately downstream relative to the vacuum slot and on the opposite side of the top wire relative to the dewatering shoe. The box defines a curved face having a center of curvature which is disposed above the top wire.

A plurality of dewatering blades are disposed in spaced relationship in a machine direction along the curved face. Each blade extends in a cross-machine direction such that the blades are disposed between the curved face and the top wire for guiding the top wire therepast.

A plurality of dewatering foils are disposed on an opposite side of the wires relative to the blades such that the consistency of the stock forming the top ply is increased during passage thereof through the forming section while maintaining the consistency of the top ply uniform in a "Z" direction so that crushing of the resultant web is inhibited.

In a more specific embodiment of the present invention, the turning bar is adjustable such that positioning of the secondary headbox closely adjacent to the lower wire is permitted so that the stock ejected from the secondary headbox is ejected substantially parallel to the lower wire from the turning bar to the dewatering shoe.

The curved surface of the turning bar in one embodiment of the present invention is ceramic.

The curved dewatering shoe also includes a plurality of spaced bars which are spaced in a machine direction. Each bar extends in a cross-machine direction, and the bars include an upstream bar.

The dewatering shoe also includes a vacuum box in fluid communication with the spaces defined between each adjacent bar.

The stock is ejected from the secondary headbox so that such stock impinges on the base ply adjacent to the upstream bar of the plurality of spaced bars.

In one embodiment of the present invention, the dewatering shoe has a radius of curvature within the range 12 to 18 meters.

The vacuum slot means is an auto-slice which includes a lip means for directing the portion of water ejected from the top ply through the top wire. The auto-slice also includes collecting tank means associated with the lip means for collecting the portion of water therein.

In a more specific embodiment of the present invention, the vacuum slot means includes a plurality of vacuum slots which are spaced relative to each other in a machine direction, each vacuum slot including an adjustable lip. The vacuum slot means also includes a collecting tank disposed above each lip, the arrangement being such that in use of the apparatus, water removed from the top ply through the top wire due to tension of the lower wire and a converging wire wedge defined between the wires is removed through the vacuum slot means so that trapping of lower consistency stock within the top ply by the formation of a fiber mat on the opposite side of the top wire relative to the vacuum slot means is inhibited.

The inverted vacuum box has a greater radius of curvature than the radius of curvature of the dewatering shoe.

Each blade of the plurality of dewatering blades is spaced at a distance relative to an adjacent dewatering blade. The distance is greater than the distance between adjacent bars of the dewatering shoe.

Each foil of the plurality of foils is disposed between adjacent blades of the plurality of dewatering blades such that the blades and foils impart dewatering pressure pulses to the multi-ply web during passage of the web between the blades and foils.

More specifically, the foils cooperate with the blades and are disposed opposite to the blades from an upstream blade along a portion of the machine direction length of the vacuum box.

In another embodiment of the present invention, the foils cooperate with the blades and are disposed opposite to the blades and downstream relative to an upstream blade to a downstream blade of the vacuum box.

Each dewatering foil includes a pair of threaded rods which are disposed parallel and spaced relative to each other and adjacent to one end of the foil.

A further pair of threaded rods are disposed spaced and parallel relative to each other adjacent an opposite end of the foil.

A yoke portion cooperates with the pair of rods such that vertical adjustment of the yoke relative to the rods is permitted.

A further yoke cooperates with the further pair of rods such that vertical adjustment of the further yoke relative to the further rods is permitted.

A foil bar having a first and a second end is arranged such that a first end of the foil bar is journalled within the first yoke, and a second end is journalled within the second yoke such that vertical adjustment of the foil bar is permitted. The journals permit rotational adjustment of the foil bar relative to the lower wire. Pneumatic tube means are disposed beneath the foil bar for adjustably loading the foil bar against the lower wire.

Many variations and modifications of the present invention will be readily apparent to those skilled in the art by a consideration of the detailed description contained hereinafter. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
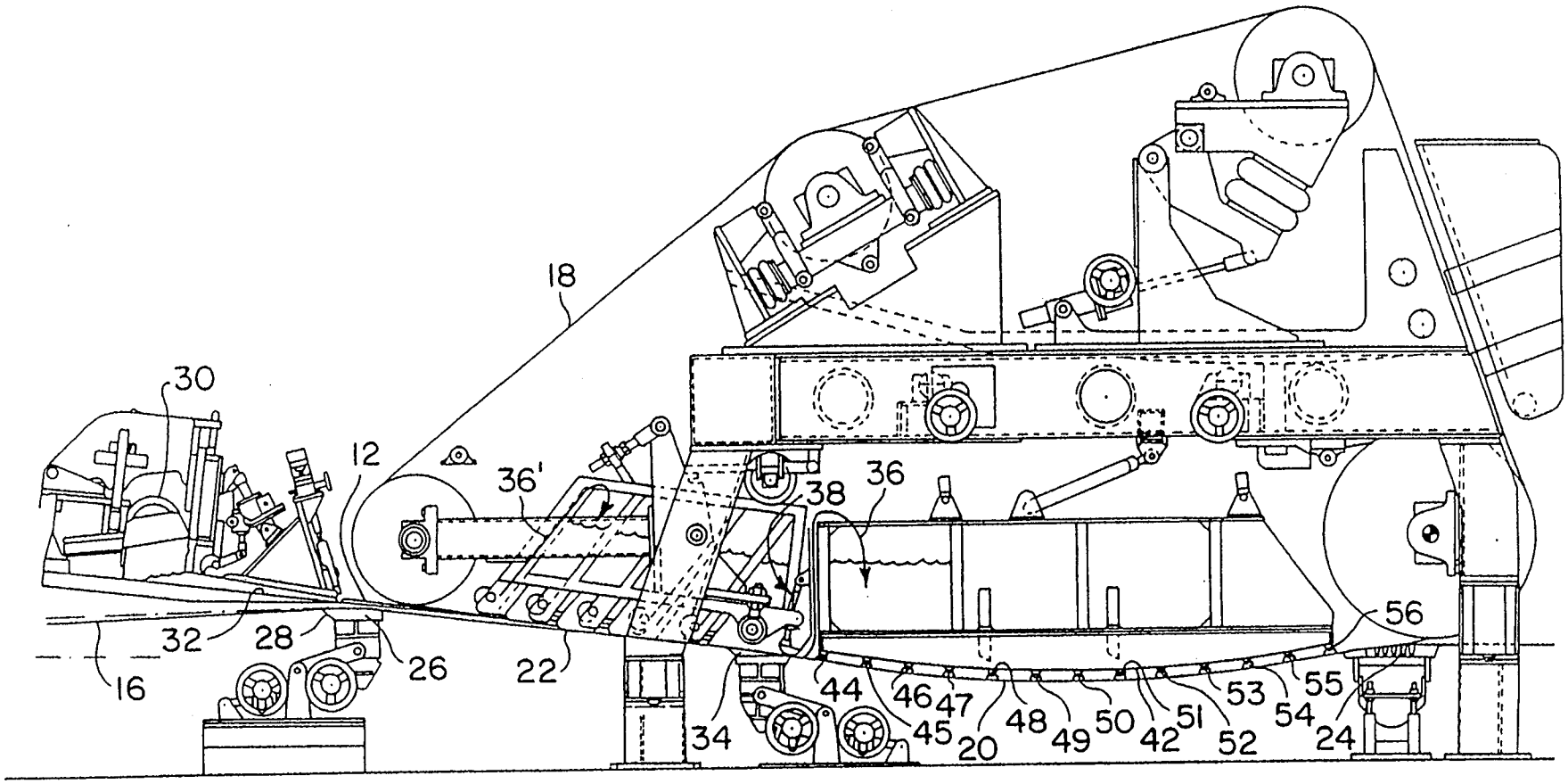
FIG. 1 is a side-elevational view of a multi-ply web forming apparatus according to the present invention.

FIG. 1 is a side-elevational view of a multi-ply web forming apparatus, generally designated 10 according to the present invention, for forming a top ply 12 on a base ply 14.

The former 10 includes a lower looped forming wire 16 for receiving the base ply 14 thereon.

A top looped forming wire 18 cooperates with and is disposed above the lower wire 16 for defining therebetween a generally horizontally disposed forming section 20 having a first and a second end 22 and 24, respectively.

A turning bar 26 defines a curved surface 28 which is disposed beneath the lower forming wire 16 and upstream relative to the first end 22 of the forming section 20 for guiding the lower wire 16.

A secondary headbox 30 is disposed closely adjacent to the turning bar 26 such that stock 32 ejected from the secondary headbox 30 towards the first end 22 of the forming section 20 is deposited on the base ply 14, the stock 32 ejected from the secondary headbox 30 generating the top ply 12.

A curved dewatering shoe 34 is disposed beneath the lower wire 16 and adjacent to the first end 22 of the forming section 20. The curved shoe 34 has a center of curvature disposed below the lower wire 16 such that a portion of water, as indicated by the arrow 36, is ejected through the top wire 18.

A vacuum slot means, generally designated 38, is disposed above the top wire 18 and immediately downstream relative to the dewatering shoe 34 for collecting the portion of water 36 upwardly away from the top wire 18.

An inverted vacuum box, generally designated 40, is disposed immediately downstream relative to the vacuum slot 38 and on the opposite side of the top wire 18 relative to the dewatering shoe 34. The box 40 defines a curved face 42 having a center of curvature disposed above the top wire 18.

A plurality of dewatering blades 44,45,46,47,48,49,50,51,52,53,54, 55 and 56 are disposed in spaced relationship in a machine direction MD along the curved face 42. Each blade 44 to 56 extends in a cross-machine direction such that the blades 44 to 56 are disposed between the curved face 42 and the top wire 18 for guiding the top wire therepast.

Figure 2:
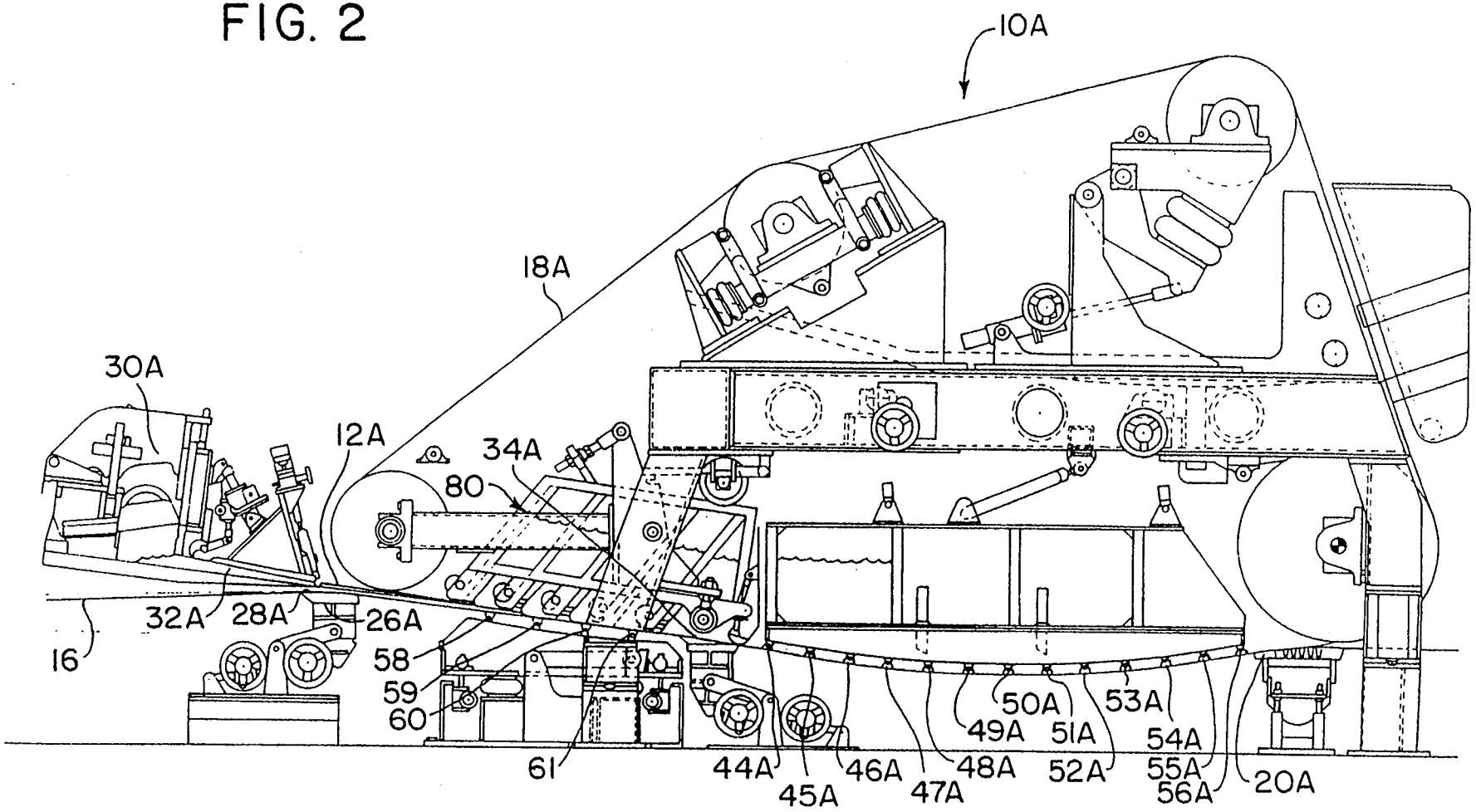
FIG. 2 is a side-elevational view of a multi-ply web forming apparatus according to a further embodiment of the present invention.

FIG. 2 is a side-elevational view of a further embodiment of the present invention showing a multi-ply web forming apparatus generally designated 10A.

The web forming apparatus 10A is essentially identical to the apparatus shown in FIG. 1, except in that the forming apparatus shown in FIG. 2 further includes a plurality of dewatering foils 58,59,60 and 61 disposed on an opposite side of the wires 16A and 18A relative to the blades 44A to 56A such that the consistency of the stock forming the top ply 12A is increased during passage thereof through the forming section 20A while maintaining the consistency of the top ply 12A uniform in a "Z" direction so that crushing of the resultant web is inhibited.

As shown in FIGS. 1 and 2, the turning bar 26,26A is adjustable such that positioning of the secondary headbox 30,30A closely adjacent to the lower wire 16,16A is permitted so that the stock 32,32A ejected from the secondary headbox 30,30A is ejected substantially parallel to the lower wire 16, 16A from the turning bar 26,26A to the dewatering shoe 34,34A.

The curved surface; 28,28A of the turning bar 26,26A is fabricated from ceramic material.

Figure 3:
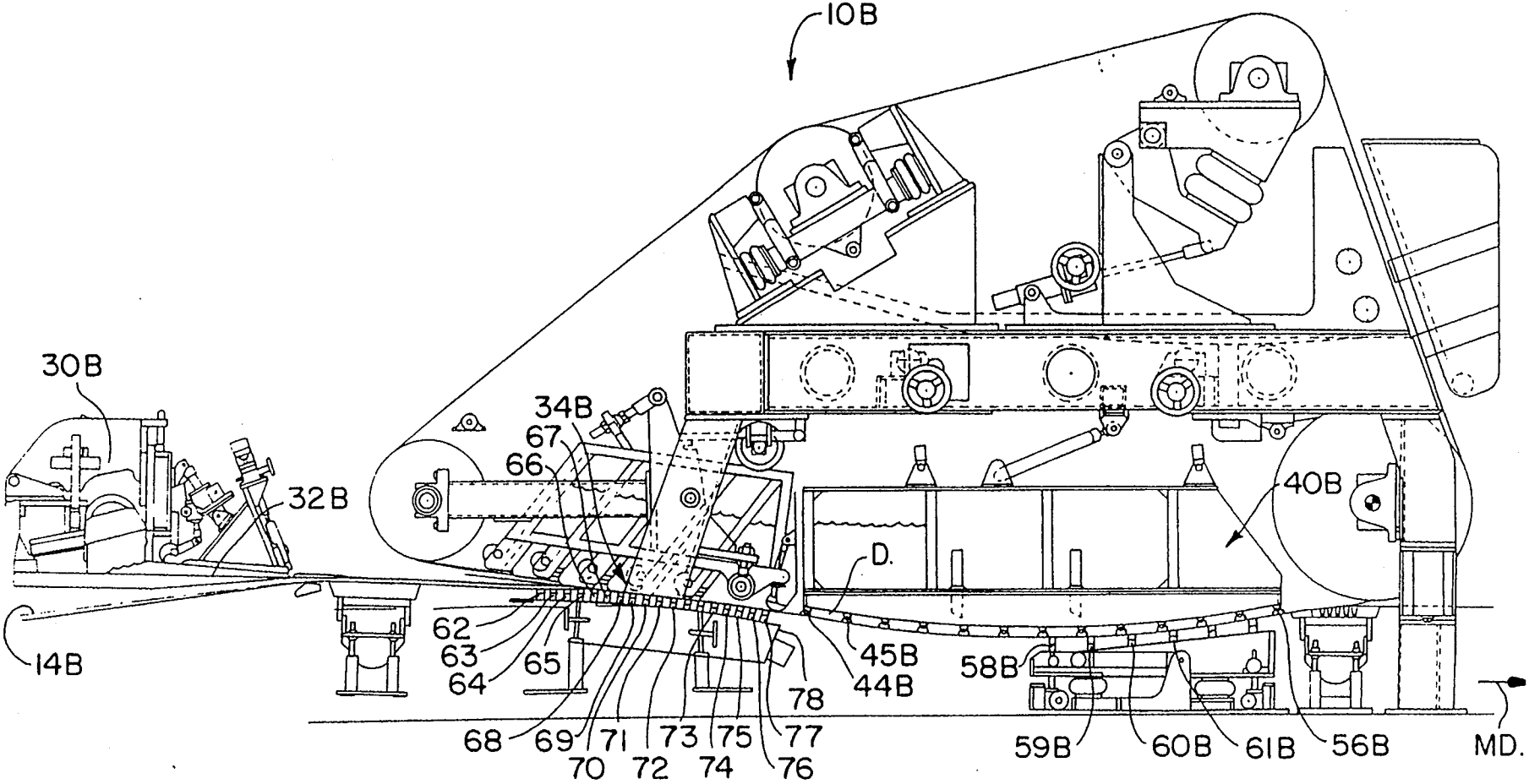
FIG. 3 is a side-elevational view of a multi-ply web forming apparatus according to yet another embodiment of the present invention.

FIG. 3 is a side-elevational view of yet another embodiment of the present invention. FIG. 3 shows a multi-ply web forming apparatus, generally designated 10B, which includes all of the essential features shown in the embodiment of FIG. 1. However, the curved dewatering shoe, generally designated 34B, includes a plurality of spaced bars 62,63,64,65, 66,67,68,69,70,71,72,73,74,75,76 and 77 spaced in a machine direction MD. Each bar, as for example bar 62, extends in a cross-machine direction, and the spaced bars 62 to 77 include an upstream bar 62.

More specifically, the dewatering shoe includes a vacuum box 78 which is in fluid communication with spaces defined between adjacent bars, such as between bars 62 and 63.

The stock 32B ejected from the secondary headbox 30B impinges on the base ply 14B adjacent to the upstream bar 62 of the plurality of spaced bars 62 to 77.

The dewatering shoe 34B has a radius of curvature within the range 12 to 18 meters.

Figure 4:
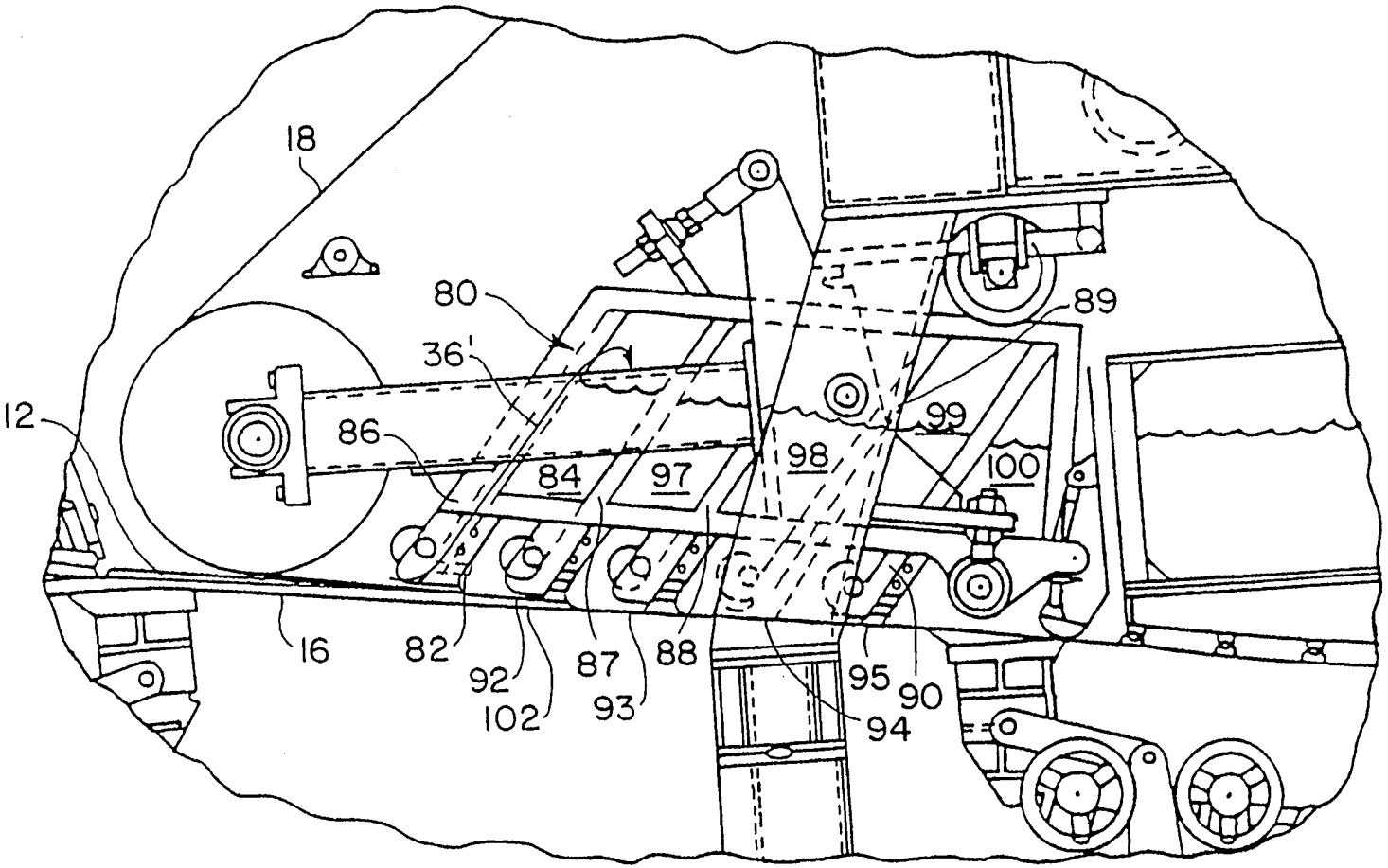
FIG. 4 is an enlarged view of the auto-slice shown in FIG. 1.

FIG. 4 is an enlarged view of the vacuum slot means 38 shown in FIG. 1. As shown in FIG. 4, in addition to the vacuum slot means 38 there is an auto-slice 80 which includes lip means 82 shown in FIG. 4 for directing the portion of water 36' ejected from the top ply 12 through the top wire 18. The auto-slice 80 also includes collecting tank means 84 associated with the lip means 82 for ,collecting the portion of water 38' therein.

As shown in FIG. 4, the auto-slice 80 more specifically includes a plurality of slots 86,87,88,89 and 90 which are spaced relative to each other in a machine direction with each slot 86 to 90 including a lip 82, 92, 93,94 and 95, respectively.

Each slot 86 to 90 includes a collecting tank 84,97,98,99 and 100 disposed above an associated lip 82 and 92 to 95, respectively. The arrangement is such that in use of the apparatus, water 38' removed from the top ply 12 through the top wire 18 due to tension of the lower wire 18 and a converging wire wedge 102 defined between the wires 18 and 18 is removed through the vacuum slot means 38 so that trapping of lower consistency stock within the top ply 12 by the formation of a fiber mat on the opposite side of the top wire 18 relative to the vacuum slot means 38 is inhibited.

In each of the embodiments shown in FIGS. 1–3, the inverted vacuum box 40 has a greater radius of curvature than the radius of curvature of the dewatering shoe 34.

Each blade, for example 44B, of the plurality of dewatering blades 44B to 56B is spaced at a distance D relative to an adjacent dewatering blade 45A, as shown in FIG. 2. The distance D is greater than the distance d between adjacent bars 62 and 63 of the dewatering shoe 34B shown in FIG. 3.

In the embodiment shown in FIG. 3, each foil of the plurality of foils 58B,59B,60B and 61B is disposed between adjacent blades of the plurality of dewatering blades 44B to 56B such that the blades 44B to 56B and foils 58B to 61B impart dewatering pressure pulses to the multi-ply web during passage of the web between the blades and foils.

Figure 5:
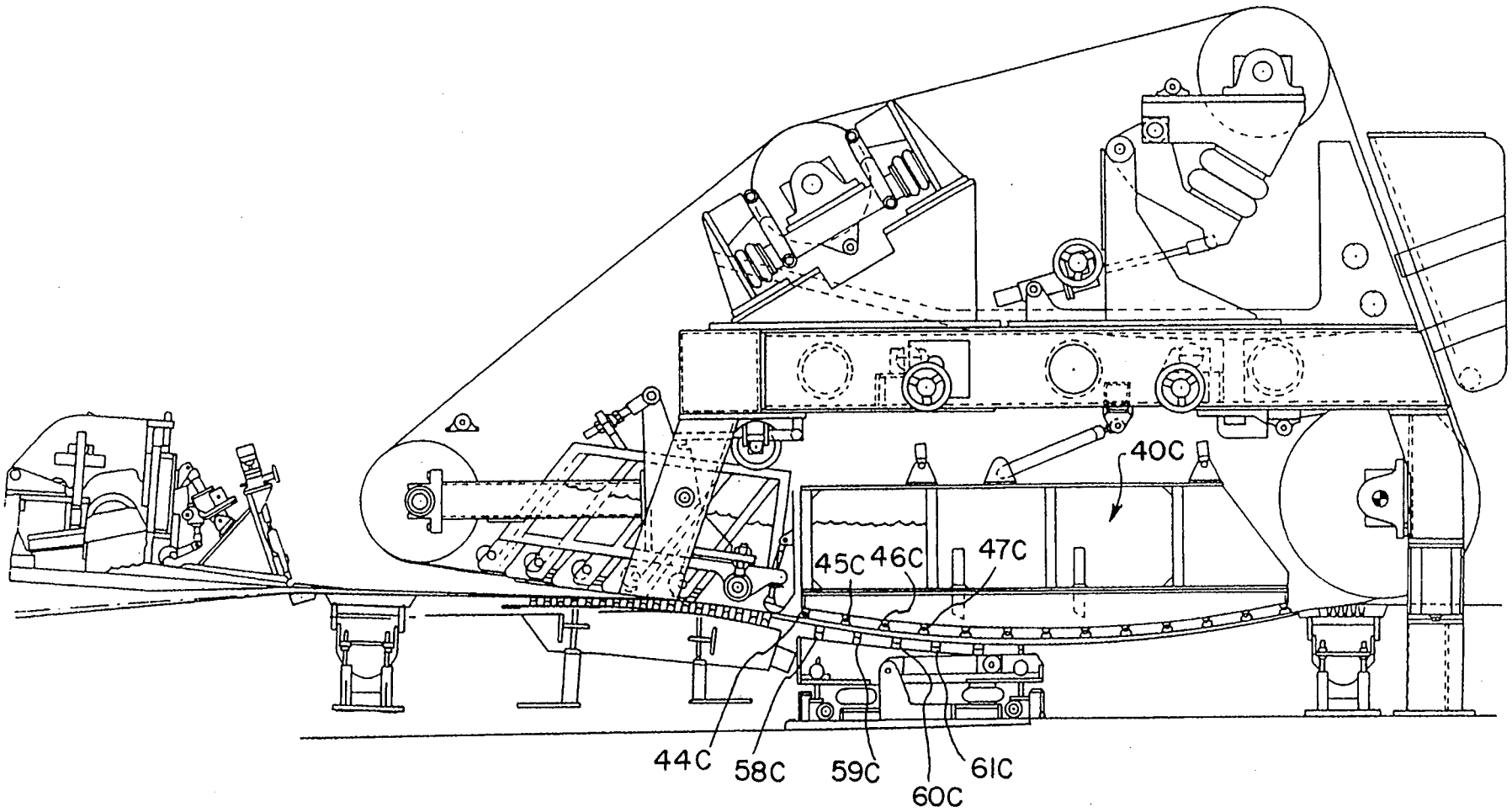
FIG. 5 is a side-elevational view of a preferred embodiment of the present invention.

FIG. 5 is a side-elevational view of a preferred embodiment of the present invention which is very similar to the embodiment shown in FIG. 3. However, the foils 58C,59C,60 and 61C cooperate with the blades 44C,45C,46C and 47C and are disposed opposite to the blades 44C to 47C from an upstream blade 44C along a portion of the machine directional length of the vacuum box 40C.

As shown in the embodiment of FIG. 3, the foils 58B to 61B cooperate with the blades 44B to 56B and are disposed opposite to the blades 44B to 56B and downstream relative to an upstream blade 44B to a downstream blade 56B of the vacuum box 40B.

In the embodiment shown in FIG. 2, the foils 59 to 61 are disposed upstream relative to the dewatering shoe 34A and opposite to the auto-slice 80.

In operation of the apparatus according to the present invention, in each of the embodiments shown in FIGS. 1 to 3 and 5, and as more clearly shown in FIG. 4, the stock forming the top ply 12 impinges on the top wire 18 in the vicinity of the leading lip 82 of the slot 86.

The lips 82 and 92 to 95 are adjusted such that as the top wire 18 extends around lips 82 and 92 to 95, the radius of curvature of the top wire 18 around the auto-slice 80 is approximately 15 meters.

Additionally, water present on the inside of the Bel Bond TM wire 18 due to the tension of the base wire 16 and the converging wire wedge 102 is removed.

No vacuum is applied within the collecting tanks 84 and 97 to 100.

The objective of the present invention is to increase the consistency of the in-coming stock in a uniform manner throughout the slurry, rather than forming a fiber mat on the outside of the Bel Bond TM wire 18 with a lower consistency beneath trapped by the base ply 14. The present invention eliminates crushing, which occurs at heavy weights in existing designs.

Also, the auto-slice unit 80 and the lead-in roll ahead of the auto-slice are both fully adjustable for optimum performance.

The present invention also includes an arrangement similar to that shown in FIG. 5, but with the auto-slice removed so that a vacuum slot only is provided within the loop of the top wire for removing water upwardly.

Additionally, the radius of curvature of the upstream portion of the curved surface of the inverted vacuum box, that is the portion having opposing foils, has a radius of curvature of approximately 15 meters, while the remainder of the curved surface of the inverted vacuum box has a radius of 5 meters.

Also, in another embodiment of the present invention, that portion of the inverted box adjacent to the opposing foils is flat, while the remainder of the curved surface is curved.

The various embodiments of the present invention enable even dewatering of the top ply in a multi-ply former so that the consistency of the stock forming the top ply is increased during passage thereof through the forming section while maintaining the consistency of the top ply uniform in a "Z" direction so that crushing of the resultant web is inhibited.

What is claimed is:

1. A multi-ply web forming apparatus for forming a top ply on a base ply, said former comprising:

a looped lower forming wire for receiving the base ply thereon;

a top looped forming wire cooperating with and disposed above said lower wire for defining therebetween a generally horizontally disposed forming section having a first and a second end;

a turning bar defining a curved surface, said curved surface being disposed beneath said lower forming wire and upstream relative to said first end of said forming section for guiding said lower wire;

a headbox disposed closely adjacent to said turning bar such that stock ejected from said headbox towards said first end of said forming section is deposited on the base ply, said stock ejected from said headbox generating the top ply;

a curved dewatering shoe disposed beneath said lower wire and adjacent to said first end of said forming section, said curved shoe having a center of curvature disposed below said lower wire such that a portion of water from the top ply is ejected through said top wire;

a vacuum slot means disposed above said top wire and immediately downstream relative to said dewatering shoe for collecting said portion of water upstream away from said top wire;

an inverted vacuum box disposed immediately downstream relative to said vacuum slot means and on the opposite side of said top wire relative to said dewatering shoe said box defining a curved face having a center of curvature disposed above said top wire;

a plurality of dewatering blades disposed in spaced relationship in a machine direction along said curved face each blade extending in a cross-machine direction such that said blades are disposed between said curved face and said top wire for guiding said top wire therepast:

a plurality of dewatering foils, said foils being disposed on an opposite side of said wires relative to said blades such that the consistency of the stock forming the top ply is increased during passage thereof through said forming section while maintaining the consistency of the top ply uniform in a "Z" direction so that crushing of the resultant web is inhibited:

said turning bar being adjustable such that positioning of said headbox closely adjacent to said lower wire is permitted so that the stock ejected from said headbox is ejected substantially parallel to said lower wire from said turning bar to said dewatering shoe;

said curved dewatering shoe further including:

a plurality of spaced bars spaced in a machine direction, each bar extending in a cross-machine direction, said spaced bars including:

an upstream bar;

said forming apparatus further including:

an auto-slice disposed upstream relative to said vacuum slot means and on the same side of said wires as said vacuum slot means, said auto-slice including:

a lip means for directing said portion of water ejected from the top ply through said top wire;

collecting tank means associated with said lip means for collecting said portion of water therein;

said auto-slice further including;

a plurality of vacuum slots spaced relative to each other in a machine direction;

said lip means including an adjustable lip associated with each vacuum slot;

a collecting tank disposed above said adjustable lip, the arrangement being such that in use of the apparatus, water removed from the top ply through said top wire due to tension of said lower wire and a converging wire wedge defined between said wires is removed through said vacuum slot means so that trapping of lower consistency stock within the top ply by the formation of a fiber mat on the opposite side of the top wire relative to said vacuum slot means is inhibited:

said inverted vacuum box having a greater radius of curvature than the radius of curvature of said dewatering shoe:

each blade of said plurality of dewatering blades being spaced at a distance relative to an adjacent dewatering blade, said distance being greater than the distance between adjacent bars of said dewatering shoe: and each foil of said plurality of foils being disposed between adjacent blades of said plurality of dewatering blades such that said blades and foils impart dewatering pressure pulses to the multi-ply web during passage of the web between said blades and foils.

2. A multi-ply web forming apparatus as set forth in claim 1 wherein said curved surface of said turning bar is ceramic.

3. A multi-ply web forming apparatus as set forth in claim 1 wherein said dewatering shoe further includes:

a vacuum box in fluid communication with spaces defined between each adjacent bar.

4. A multi-ply web forming apparatus as set forth in claim 1, wherein said stock ejected from said headbox impinges on the base ply adjacent to said upstream bar of said plurality of spaced bars.

5. A multi-ply web forming apparatus as set forth in claim 1, wherein said dewatering shoe has a radius of curvature within the range 12 to 18 meters.

* * * * *

UNITED STATES PATENT AND TRADEMARK OFFICE

CERTIFICATE OF CORRECTION

PATENT NO. : 5,427,654

DATED : June 27, 1995

INVENTOR(S) : Paul Gray and Eric Ormesher

It is certified that error appears in the above-indentified patent and that said Letters Patent is hereby corrected as shown below:

| | |
|---|---|
| Column 1, line 55 | "1:o" should read --to--. |
| Column 5, line 48 | "38'" should read --36'--. |
| Column 5, line 57 | "38'" should read --36'--. |
| Column 5, line 60 | "18" should read --16--. |

Signed and Sealed this

Fourth Day of June, 1996

Bruce Lehman

*Attest:*

BRUCE LEHMAN

*Attesting Officer*

*Commissioner of Patents and Trademarks*